US008974329B2

(12) United States Patent
Laliberty

(10) Patent No.: US 8,974,329 B2
(45) Date of Patent: Mar. 10, 2015

(54) GAME BALL

(75) Inventor: Ronald P. Laliberty, Dudley, MA (US)

(73) Assignee: Russell Brands, LLC, Alexander City, AL (US)

( * ) Notice: Subject to any disclaimer, the term of this patent is extended or adjusted under 35 U.S.C. 154(b) by 1390 days.

(21) Appl. No.: 12/164,509

(22) Filed: Jun. 30, 2008

(65) Prior Publication Data

US 2009/0069122 A1 Mar. 12, 2009

Related U.S. Application Data

(60) Provisional application No. 60/971,151, filed on Sep. 10, 2007.

(51) Int. Cl.
*A63B 41/08* (2006.01)

(52) U.S. Cl.
CPC ..... *A63B 41/08* (2013.01)
USPC ..... 473/604; 473/607; 156/147; 156/170; 156/186

(58) Field of Classification Search
USPC ..... 473/603–605, 597–599, 607; 156/145, 156/147, 170, 186, 212, 213
See application file for complete search history.

(56) References Cited

U.S. PATENT DOCUMENTS

| | | | | | |
|---|---|---|---|---|---|
| 2,129,237 | A * | 9/1938 | Riddell | 156/147 |
| RE21,115 | E * | 6/1939 | Winterbauer | 473/605 |
| 2,221,534 | A * | 11/1940 | Voit et al. | 156/147 |
| 2,317,939 | A * | 4/1943 | Riddell | 156/147 |
| 2,609,202 | A * | 9/1952 | Winterbauer | 156/145 |
| 2,623,747 | A * | 12/1952 | Crowley | 156/147 |
| 4,462,590 | A * | 7/1984 | Mitchell | 473/603 |
| 5,636,835 | A | 6/1997 | Schindler et al. | |
| 5,681,233 | A | 10/1997 | Guenther et al. | |
| 6,022,283 | A | 2/2000 | Schindler et al. | |
| 6,123,633 | A * | 9/2000 | Guenther et al. | 473/604 |
| 6,406,389 | B1 * | 6/2002 | Feeney et al. | 473/604 |
| 6,506,135 | B2 | 1/2003 | Ou | |
| 6,544,133 | B2 | 4/2003 | Ou | |
| 7,137,915 | B2 * | 11/2006 | Lin | 473/605 |
| 2005/0153803 | A1 * | 7/2005 | Swiszcz et al. | 473/604 |
| 2008/0139349 | A1 * | 6/2008 | Ou | 473/604 |
| 2009/0209374 | A1 * | 8/2009 | Ou | 473/605 |
| 2009/0325744 | A1 * | 12/2009 | Raynak et al. | 473/604 |

* cited by examiner

*Primary Examiner* — Steven Wong

(74) *Attorney, Agent, or Firm* — Bradley Arant Boult Cummings LLP

(57) ABSTRACT

A method of making a game ball having a carcass comprising a foamed intermediate layer and a plurality of raised seams made from an outer layer is disclosed. The foamed intermediate layer may be formed from two sheets of foamed material. The sheets are shaped to have leaves that can be folded into the shape of a hemisphere with no gaps between adjacent leaves. The sheets are placed around a bladder, an outer layer is placed around the sheets, and the combination is heat molded. The seams are not made from strips of seam material placed on the outer layer of the carcass.

15 Claims, 7 Drawing Sheets

GAME BALL

CROSS-REFERENCE TO RELATED APPLICATIONS

This application claims priority from U.S. Provisional Patent Application No. 60/971,151, filed Sep. 10, 2007. That application is hereby fully incorporated by reference.

BACKGROUND

The present disclosure relates to the field of sports or game balls, particularly inflatable game balls such as basketballs. More particularly, the disclosure relates to a multi-layered game ball having a foamed intermediate layer and a process for the manufacture thereof.

It is well known to produce a game ball having multiple layers of differing materials. Each layer of the multi-layer game ball is directed to providing a specific function or characteristic for a given performance requirement. For example, a game ball may be produced of two layers. The outer layer may provide for durability, feel and playability properties, etc., and the inner layer, such as a bladder, may provide for pressure retention. One or more intermediate layers may also be provided to improve compression, resilience, coefficient of restitution, etc. Multi-layer game balls therefore typically have superior performance characteristics over single layer balls.

U.S. Pat. No. 5,636,835 discloses a game ball that is made by placing panels of foamable (i.e. capable of later being foamed) rubber on the bladder. The foamable rubber panels are made from a type of rubber that is designed to foam upon application of heat. Narrow strips of seam material are then attached over the foamable rubber panels. The seam material has a raised portion and flanged portions. This arrangement is then cured (i.e., heated, etc.). During the curing process, the foamable rubber reacts to become a foamed sponge rubber layer. The foamed material also rises into the raised portion of the seam material. Exterior cover panels are then placed between seams to form a finished ball.

U.S. Pat. No. 5,681,233 discloses a game ball that is made by also placing a plurality of foamable panels on the bladder. However, strips of rubber are then placed in the gaps between adjacent panels. This arrangement is then cured (i.e., heated, etc.) so that the panels become foamed and the rubber strips fuse to the bladder and the sponge rubber panels, forming seams. Cover panels are also then placed between seams to form the finished ball.

U.S. Pat. Nos. 6,506,135 and 6,544,133 disclose sportsballs that are made by placing a plurality of cushion panels on the bladder, then placing strips of rubber in the gaps between adjacent cushion panels. The cushion panels comprise an inner rubber layer, a foamed layer, and an outer rubber layer. Upon heating, the rubber strips, inner rubber layer, and outer rubber layer melt together. Seams are formed at locations corresponding to the rubber strips.

It would desirable to produce a multi-layer sports ball having an improved foamed intermediate layer.

BRIEF DESCRIPTION

Disclosed, in various embodiments, are game balls having a carcass including a foamed sponge rubber layer and seams formed from the outer layer of the game ball carcass. The carcass and methods of making such a carcass are also disclosed.

In embodiments, a method for forming an inflatable ball carcass having a foamed sponge layer comprises:

- providing an inflatable bladder and a plurality of outer layer sheets;
- providing two foamed sponge layer sheets, each foamed sponge layer sheet having a first side and a second side, and a plurality of leaves or petals extending from a center, the leaves shaped so that the foamed sponge layer sheet can be folded into substantially the shape of a hemisphere with substantially no gap remaining between each pair of adjacent leaves;
- placing the outer layer sheets on the first side of each foamed sponge layer sheet so that the foamed sponge layer sheet is substantially covered by the outer layer sheets;
- placing the bladder on the second side of each foamed sponge layer sheet so that the foamed sponge layer sheets substantially cover the bladder to form a semi-finished ball carcass; and
- heat molding the semi-finished ball carcass to form an inflatable ball carcass having a sponge layer.

Each sponge layer sheet may have two or more leaves, including four to eight leaves.

The inflatable ball carcass may further comprise a plurality of raised seams on the inflatable ball carcass, the plurality of raised seams being formed from the outer layer sheets.

The heat molding step may comprise a laminating step, a curing step, and a vulcanizing step.

In other embodiments, a method for forming an inflatable ball carcass having a sponge layer and a plurality of raised seams comprises:

- providing an inflatable bladder and a plurality of outer layer sheets;
- providing two foamed sponge layer sheets, each foamed sponge layer sheet having a first side and a second side, and a plurality of leaves extending from a center, the leaves shaped so that the foamed sponge layer sheet can be folded into substantially the shape of a hemisphere with substantially no gap remaining between each pair of adjacent leaves;
- placing the outer layer sheets on the first side of each foamed sponge layer sheet so that the foamed sponge layer sheet is substantially covered by the outer layer sheets;
- placing the bladder on the second side of each foamed sponge layer sheet so that the foamed sponge layer sheets substantially cover the bladder to form a semi-finished ball carcass; and
- heat molding the semi-finished ball carcass to form an inflatable ball carcass having a sponge layer and a plurality of raised seams, the raised seams being formed from the outer layer sheets.

In other embodiments, a method for forming an inflatable ball carcass having an intermediate sponge layer and a plurality of raised seams comprises:

- providing an inflatable bladder and a plurality of outer layer sheets;
- providing two foamed sponge layer sheets, each foamed sponge layer sheet having a first side and a second side, and eight leaves extending from a center, the leaves shaped so that the foamed sponge layer sheet can be folded into substantially the shape of a hemisphere with substantially no gap remaining between each pair of adjacent leaves;

placing the outer layer sheets on the first side of each foamed sponge layer sheet so that the foamed sponge layer sheet is substantially covered by the outer layer sheets;

placing the bladder on the second side of each foamed sponge layer sheet so that the foamed sponge layer sheets substantially cover the bladder to form a semi-finished ball carcass; and heat molding the semi-finished ball carcass to form an inflatable ball carcass having a sponge layer and a plurality of raised seams, the raised seams being formed from the outer layer sheets.

In still other embodiments, a method for forming an inflatable ball carcass having a sponge layer comprises:

providing an inflatable bladder and a plurality of outer layer sheets;

providing a plurality of foamed sponge layer sheets, the foamed sponge layer sheets having shapes such that they can be arranged into substantially the shape of a sphere with substantially no gap remaining between them;

arranging the outer layer sheets on the foamed sponge layer sheets so that a first side of the foamed sponge layer sheets is substantially covered by the outer layer sheets;

placing the bladder on a second side of the foamed sponge layer sheets so that the foamed sponge layer sheets substantially cover the bladder to form a semi-finished ball carcass; and heat molding the semi-finished ball carcass to form an inflatable ball carcass having a sponge layer.

The inflatable ball carcass may further comprise a plurality of raised seams which are formed from the outer layer sheets.

In other embodiments, a method for forming an inflatable ball carcass having a sponge layer comprises:

providing an inflatable bladder and a plurality of outer layer sheets;

providing a plurality of foamed sponge layer sheets, each sheet having a first side and a second side, and shaped so that the plurality of sheets can be folded into substantially the shape of a sphere with substantially no gap remaining between each pair of adjacent sheets;

placing the outer layer sheets on the first side of each foamed sponge layer sheet so that the sheets are substantially covered by the outer layer sheets;

placing the bladder on the second side of each foamed sponge layer sheet so that the plurality of sheets substantially cover the bladder to form a semi-finished ball carcass; and heat molding the semi-finished ball carcass to form an inflatable ball carcass having a sponge layer.

The plurality of foamed sponge layer sheets may be a total of two, four, eight, or sixteen sheets. All of the foamed sponge layer sheets may have the same shape.

In some embodiments, an inflatable game ball carcass comprises:

an inflatable bladder;

a winding layer over the bladder;

a layer of foamed sponge rubber over the winding layer; and a cover layer of rubber having integrally formed raised seams.

In other embodiments, an inflatable game ball comprises:

an inflatable bladder;

a winding layer over the bladder;

a layer of foamed sponge rubber over the winding layer;

a cover layer of rubber having integrally formed raised seams defining panel areas; and cover panels covering the panel areas.

These and other non-limiting characteristics are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
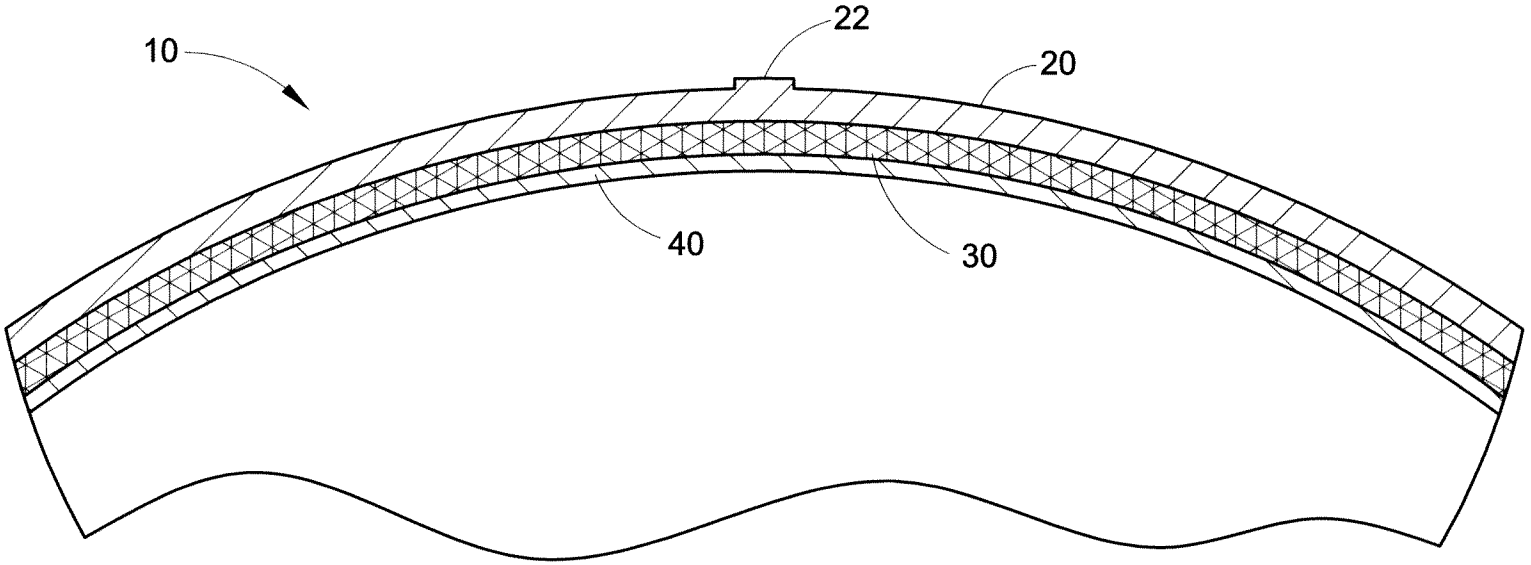
FIG. 1 is a cross-sectional view of a game ball carcass made according to the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The present disclosure relates to methods of making game balls, including carcasses thereof, that have a pre-formed foamed intermediate layer and seams formed from the outer layer of the carcass. In particular, the game ball is a basketball, however, other inflatable or air-filled bladder game balls (i.e., footballs, soccer balls, volleyballs, generic play balls, etc.) are also contemplated by this disclosure.

FIG. 1 is a cross-sectional view of a game ball carcass 10 made according to the present disclosure. The carcass 10 includes an outer cover layer 20, a foamed sponge layer 30, and a bladder layer 40. An inner layer between the foamed sponge layer 30 and the bladder layer 40 can be optionally included if desired, but is not shown here. The outer cover layer 20 has raised seams 22 which are formed from the outer cover layer 20 itself.

Figure 2:
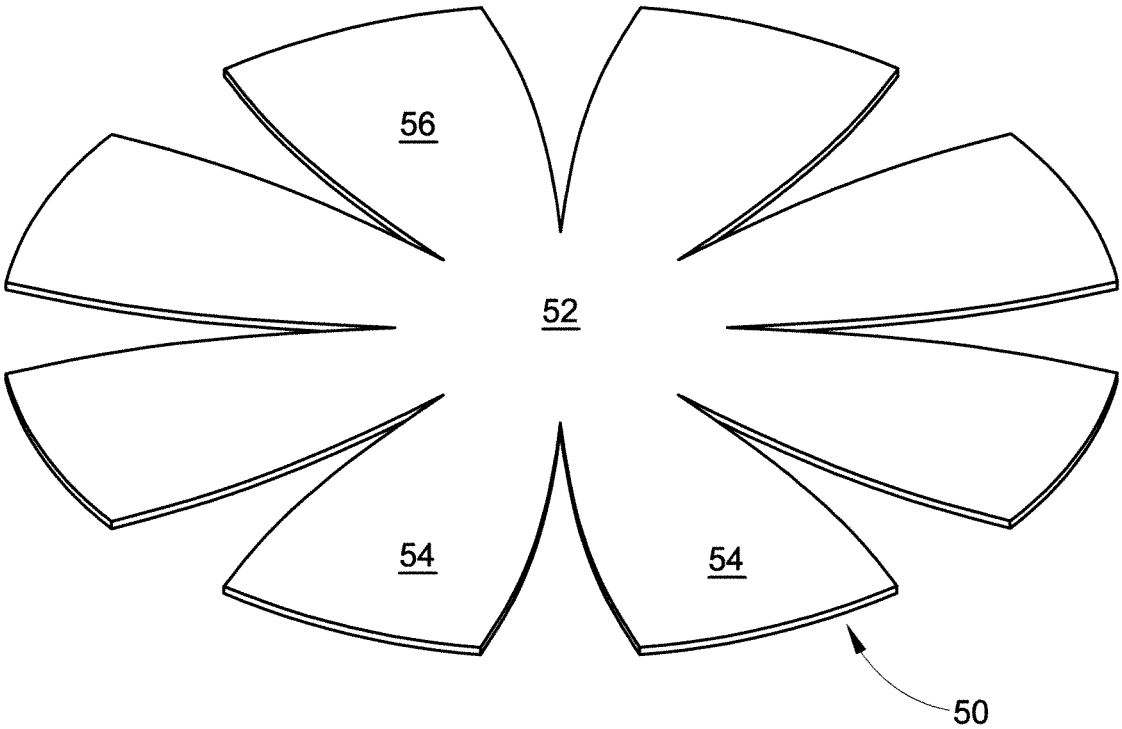
FIG. 2 is a view of a foamed sponge layer sheet which is used to form the foamed intermediate and outer layer in the game ball carcass.

FIG. 2 is a view of a foamed sponge layer sheet 50 which is used to form the foamed sponge layer 30 in the game ball carcass 10. In the embodiment shown, the sponge layer sheet 50 has a plurality of leaves 54 extending from a center 52. Here, the sponge layer sheet 50 has eight leaves. The sponge layer sheet 50 has a first side (not shown) and a second side 56. The leaves 54 are shaped so that the sponge layer sheet 50 can be folded into substantially the shape of a hemisphere with substantially no gap remaining between each pair of adjacent leaves.

Figure 3:
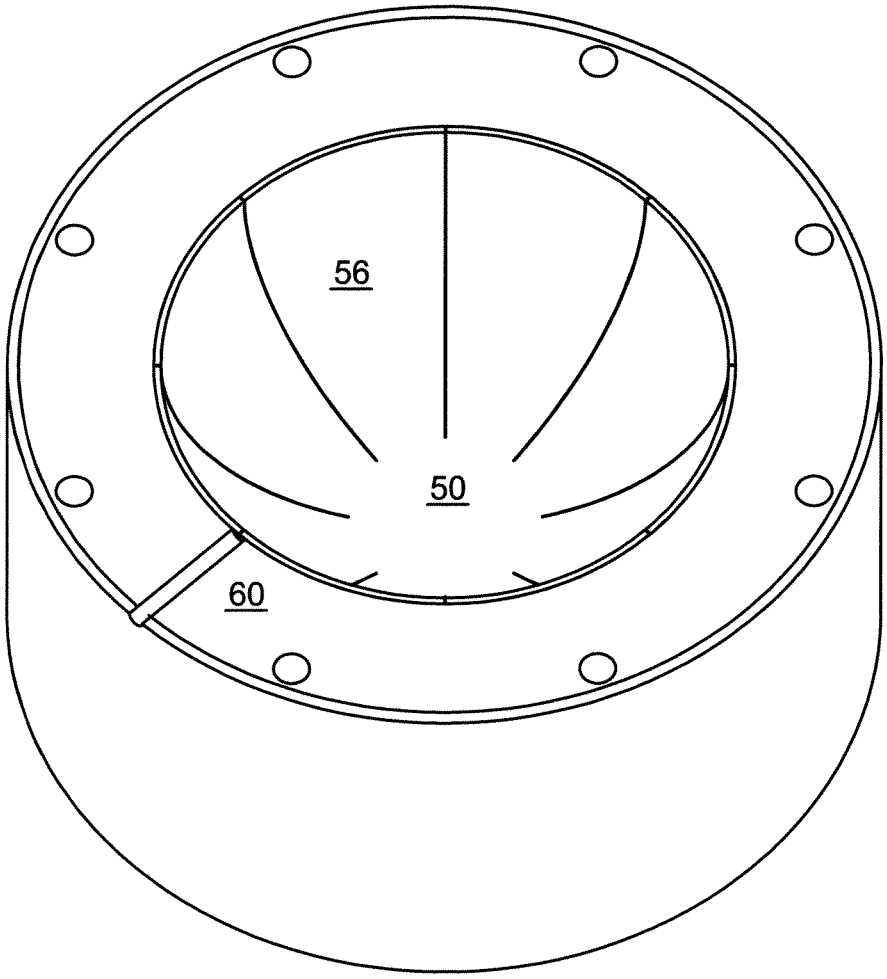
FIG. 3 is a view of a foamed sponge layer sheet placed in a mold.

FIG. 3 is a view of the foamed sponge layer sheet 50 in a mold 60, preferably a spherical mold. Under the sponge layer sheet 50 is at least one outer layer sheet (not shown) which is used to form the outer cover layer 20. The outer layer sheet(s) is/are placed so that the first side of the sponge layer sheet 50 is substantially covered. The second side 56 of the sponge layer sheet 50 is visible in this view. As seen here, the sponge layer sheet 50 is folded into a hemisphere, so that two such sheets are needed to form a sphere (or ball). Again, an inner cover sheet can optionally be included.

The interior surface of the ball mold may be engraved or tooled to impart a surface pattern to the outer cover layer of the carcass. For example, seam areas or other surface configurations may be added to the mold surface for molding into the outer cover layer.

The foamed sponge layer may be formed from a sheet of foamed material. The foam may be formed in the presence of a surface active compound by forcing air or a gas into the material, by release of gases dissolved under pressure, or by generation of gas through a chemical reaction (carbon dioxide from acidified carbonates, for example). The foam may be stabilized by a surfactant or foam stabilizer.

The foamed sponge layer can be made from natural and synthetic latexes, e.g. polystyrene, polyurethane, and other polymer materials. Preferably, the sheet of foamed material is a porous, very light substance made from various plastics such as epoxide resins, urea resins, polyurethane, polystyrene, polyethylene or polyvinyl chloride. They are synthesized either by incorporation of air into an aqueous solution or dispersion of a resin, or by propellants. In this case a propellant is worked into the plastic which either evaporates when heated (e.g. pentane) or decomposes, forming a gas (e.g. azoisobutyrodinitrile or dinitrosopentamethylene tetramine) which expands the plastic. Premolded plastic foam parts can be made by placing the plastic (for example, a pentane-containing polystyrene granulate) in a steam-heated mold before it is foamed. A distinction is made between soft and hard F., which can be further subdivided into open-pored and closed-pored F. Soft F. are used for all types of padding and as sponges, while hard F. are generally used as low-density (0.005 to 0.1 g $cm^{-3}$) hard foams.

Alternatively, foamed rubber can also be utilized. A foamed rubber is highly elastic, porous and lightweight rubber with a density of 0.10 to 0.25 g $cm^{-3}$; there are several methods of making it directly from latex. 1) The latex mixture containing gas-producing foaming agents, surfactants and heat sensitizers is converted to an aqueous foam by vigorous stirring, then coagulated in a metal mold at a temperature of 60° to 70° C. 2) The latex mixture is foamed by oxygen released enzymatically from hydrogen peroxide and coagulated by passing carbon dioxide through it, or by addition of sodium fluorosilicate. 3) The latex mixture is prevulcanized and saturated with nitrogen under high pressure in an autoclave. When the pressure is released, the mixture is blown up by the escaping nitrogen and is fixed by vulcanization. Synthetic fibers, fiberglass or similar materials can be added to give the F. more strength.

Figure 4:
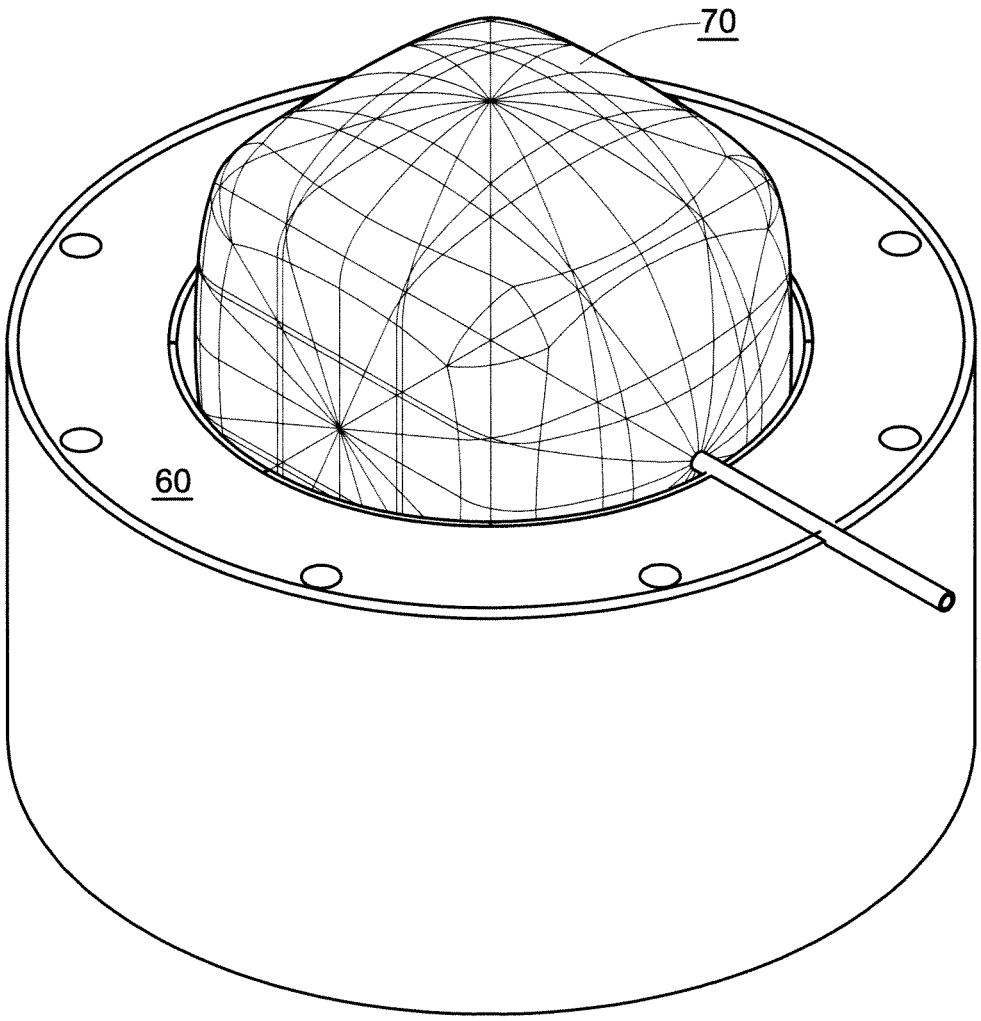
FIG. 4 is a view of an inflatable bladder with windings being added to the foamed sponge layer sheet in a mold.

In FIG. 4, an inflatable bladder 70 has been placed into the mold 60. The inflatable bladder comprises an inner inflatable bladder (not seen) for holding air or a gas or a mixture thereof and a reinforcing winding layer; the winding layer is seen here.

The winding layer comprises monofilament windings which are wrapped around the bladder to help the bladder maintain its shape when inflated. The bladder is typically made of, for example, a butyl rubber composition including halobutyl rubber (chloro- or bromo-butyl rubber), or other similar resilient, stretchable material for holding air or a gas. The bladder is generally spherical shaped and is equipped with a valve for providing air or gas under pressure to be introduced into the interior of the bladder for inflation. The winding layer (or wound reinforcing layer) is typically formed of monofilaments of polyester and/or nylon and is wrapped around the bladder (not shown) in either a predetermined pattern or a random fashion to help the final ball retain a spherical shape under typical inflation pressure and under the stresses of use. The windings can be coated with an adhesive which allows them to adhere to the bladder and also to each other.

During formation of the foamed intermediate carcass, the bladder and windings may be partially deflated when added to the mold containing the foamed sponge layer sheet 50. This assists in the manufacturing process. The bladder can then be subsequently pressurized or partially pressurized to assist in the lamination and/or molding process.

FIG. 3 shows only half of the ball carcass. The same preparations are made for the other half, such that a total of two sponge layer sheets 50 are needed to make one game ball carcass 10. This combination of bladder, sponge layer sheets, and outer layer sheets may be considered a semi-finished ball carcass.

The mold is then closed and heated and pressurized to laminate the inflatable bladder 70, sponge layer sheets 50, and outer layer sheets into a game ball carcass having a foamed sponge layer 30 and an outer cover layer 20. The mold may be used to form raised seams 22 on the outer cover layer 20 which are formed from the material of the outer layer sheets. Thus, the raised seams here are not formed from additional strips of rubber, etc., placed on the surface of the outer cover layer.

Figure 5:
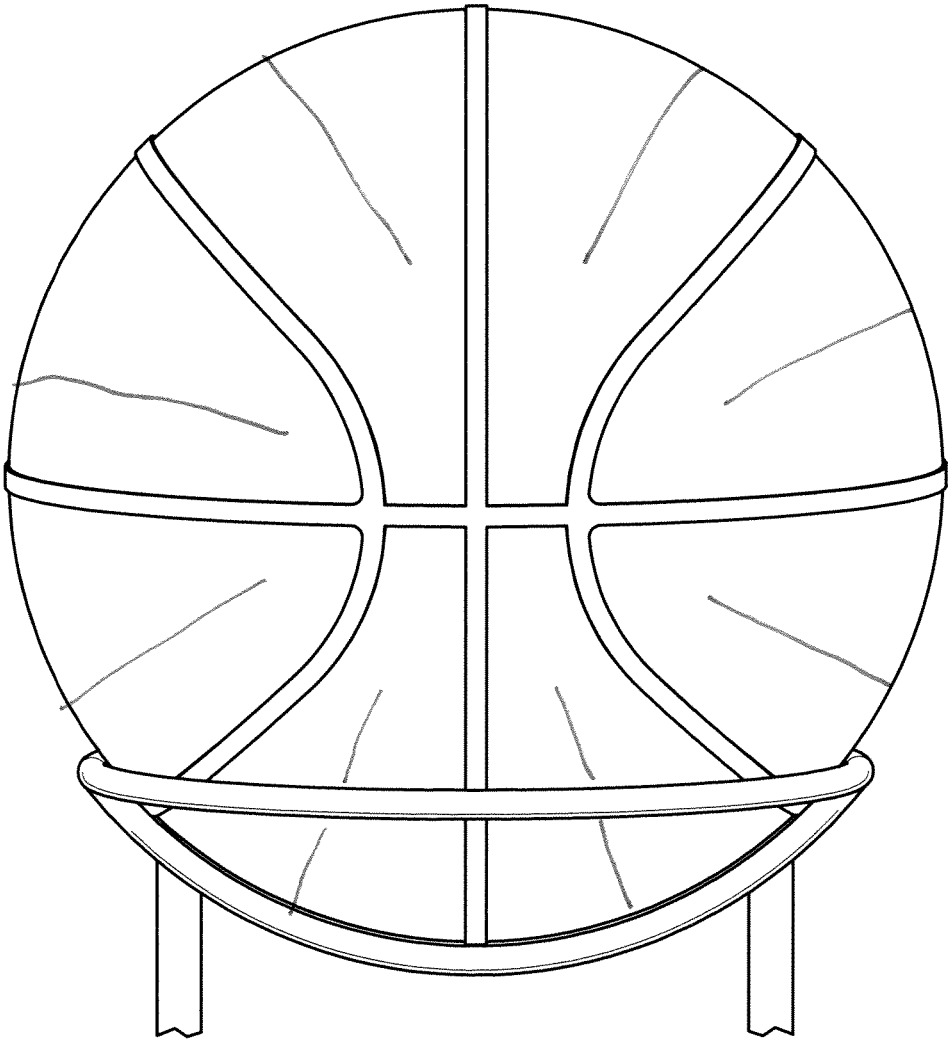
FIG. 5 is a view of the inflatable ball carcass after lamination.
Figure 6:
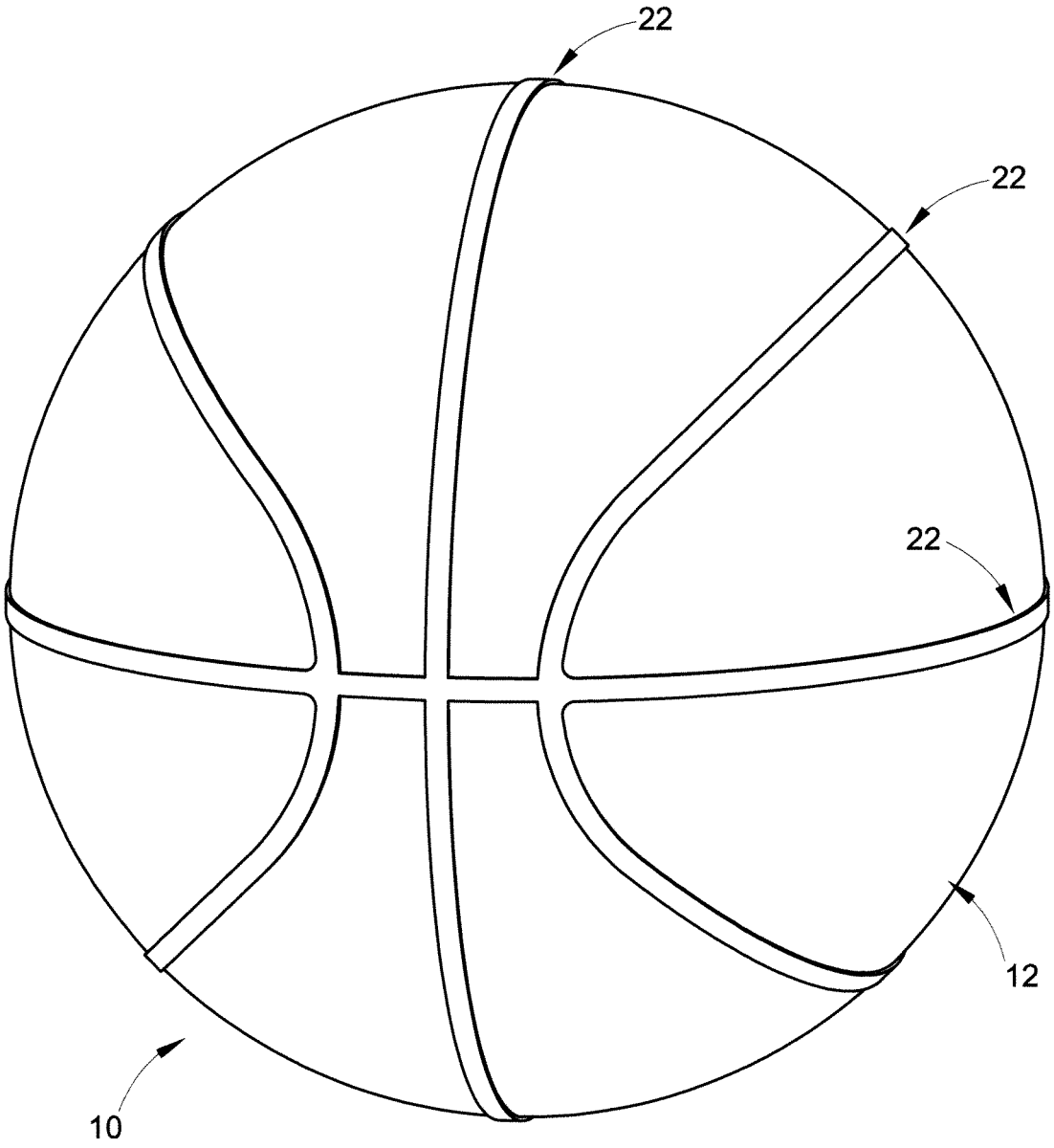
FIG. 6 is a view of the ball carcass after vulcanization.

FIG. 5 is a view of the inflatable ball carcass 10 after lamination. The carcass may then be cured and vulcanized. FIG. 6 is a view of the ball carcass 10 after vulcanization. Raised seams 22 are visible. Panel areas 12 are defined by the raised seams 22 and cover panels (not shown) are placed in these panel areas to complete the game ball. Alternatively, when outer cover panels are not desired, the outer cover layer 20 may be molded to simulate the outer cover layer of a finished basketball. For example, the outer cover layer may be molded to include a textured outer surface for improving the grip and feel of the ball. Other surface detail including the manufacturer's name, model number, trademarks, graphics, etc. can also be molded into the outer cover surface.

As shown in FIG. 2, the foamed sponge layer sheet 50 has eight leaves 54 of equal shape. However, the number of leaves can vary as long as they can be arranged into substantially the shape of a hemisphere with substantially no gap between adjacent leaves. There is also no requirement that all of the leaves have the same shape. The shapes of the leaves may vary as long as they can be arranged into substantially the shape of a hemisphere with substantially no gap between adjacent leaves. The leaves may also be slightly overlapped to ensure the structural integrity of the outer cover layer.

More broadly, the foamed sponge layer 30 can be formed from a plurality of foamed sponge layer sheets which are shaped so that the plurality of sheets can be folded into substantially the shape of a sphere with substantially no gap remaining between each pair of adjacent sheets. These embodiments do not require that the plurality of sheets necessarily form two hemispheres prior to forming a sphere. In specific embodiments, the plurality of sheets may be a total of two, four, eight, or sixteen sheets. In other specific embodiments, all of the sheets have the same shape. For example, when the plurality is two sheets of the same shape, the sheet is the sheet 50 depicted in FIG. 2.

It should be noted that the foamed sponge layer sheet has already been foamed. It is not placed on the bladder as a foamable material that is subsequently foamed by heating in a mold, as described in U.S. Pat. No. 5,636,835. In other words, the foamed material does not generate gas upon heating.

The carcass so formed can then be covered by various different types of cover materials, i.e. natural or synthetic leather, etc. For example, the carcass can be formed with protruding channels, seams, or ribs, which provide assistance in locating the cover panels in position on the ball. The panels may then be glued or applied to the carcass to fit between the pre-formed channels, seams, or ribs.

Figure 7:
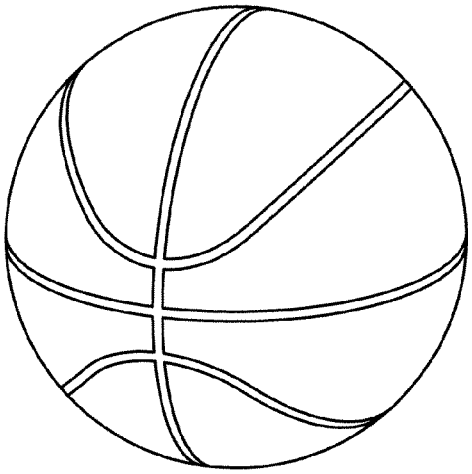
FIG. 7 is a first perspective view of a typical 8-panel basketball which can be made using the game ball carcass of the present disclosure.
Figure 8:
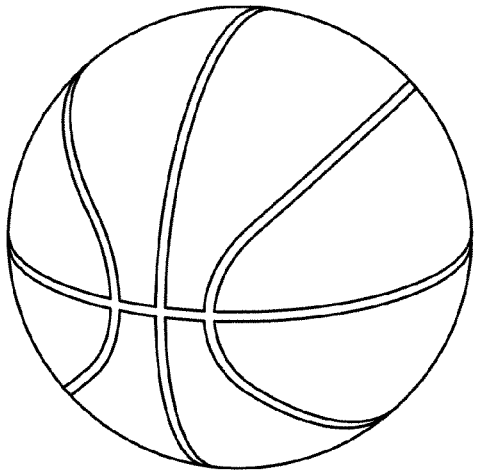
FIG. 8 is a second perspective view of the basketball set forth in FIG. 7 which can be made using the game ball carcass of the present disclosure.
Figure 9:
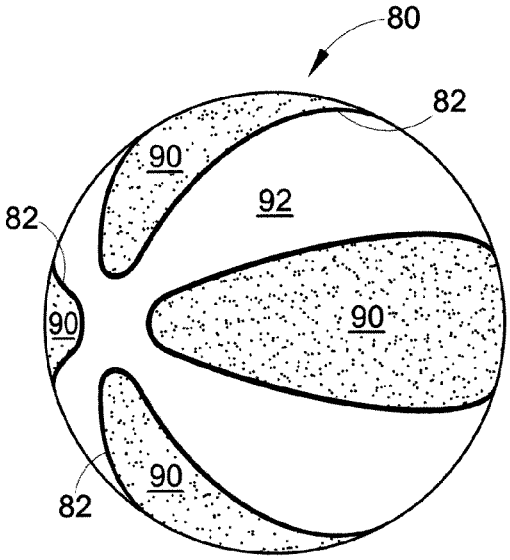
FIG. 9 is a first perspective view of another embodiment of a basketball which can be made using the game ball carcass of the present disclosure.
Figure 10:
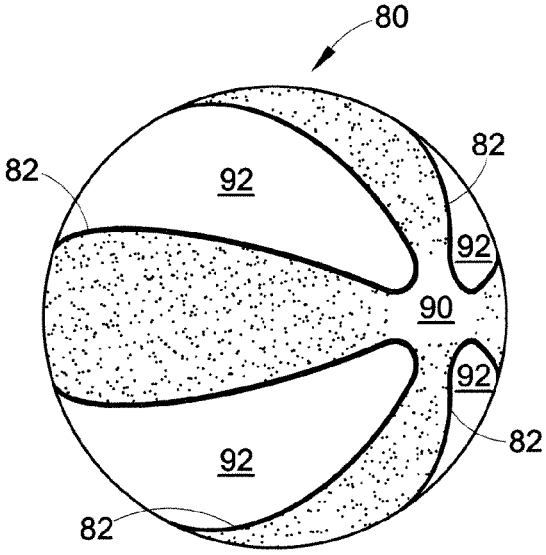
FIG. 10 is a second perspective view of the basketball set forth in FIG. 9 which can be made using the game ball carcass of the present disclosure.

The game ball carcasses of the present disclosure can be used to make, for example, basketballs. Typically, the overall ball comprises a total of eight (8) exterior cover panels of the noted configuration shown in FIGS. 7 and 8. They can also be used in a basketball having the design shown in FIGS. 9 and 10. These are perspective views of the NBA basketball shown in U.S. Design Pat. No. D522,596. This basketball 80 is made from two interlocking panels 90, 92 and having only one raised seam 82. Representative manufacturing techniques and other details for forming inflatable sports balls, such as basketballs, are also described in U.S. Pat. Nos. 5,681,233; 6,520,877; 3,405,018; 5,310,178; and 5,741,195.

The game balls, game ball carcasses, and methods of the present disclosure have been described with reference to exemplary embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A method for forming an inflatable ball carcass having a sponge layer, the method comprising:

providing an inflatable bladder and a plurality of outer layer sheets;

providing two foamed sponge layer sheets, each foamed sponge layer sheet having a first side and a second side, and a plurality of leaves extending from a center, the leaves shaped so that the foamed sponge layer sheet can be folded into substantially the shape of a hemisphere with substantially no gap remaining between each pair of adjacent leaves;

placing the outer layer sheets on the first side of each foamed sponge layer sheet so that the foamed sponge layer sheet is substantially covered by the outer layer sheets;

placing the bladder on the second side of each foamed sponge layer sheet so that the foamed sponge layer sheets substantially cover the bladder to form a semi-finished ball carcass; and heat molding the semi-finished ball carcass to form an inflatable ball carcass having a sponge layer.

2. The method of claim 1, wherein each sponge layer sheet has eight leaves.

3. The method of claim 1, wherein the inflatable ball carcass further comprises a plurality of raised seams on the inflatable ball carcass, the plurality of raised seams being formed from the outer layer sheets.

4. The method of claim 1, wherein the heat molding step comprises a laminating step, a curing step, and a vulcanizing step.

5. A method for forming an inflatable ball carcass having a sponge layer and a plurality of raised seams, the method comprising:

providing an inflatable bladder and a plurality of outer layer sheets;

providing two foamed sponge layer sheets, each foamed sponge layer sheet having a first side and a second side, and a plurality of leaves extending from a center, the leaves shaped so that the foamed sponge layer sheet can be folded into substantially the shape of a hemisphere with substantially no gap remaining between each pair of adjacent leaves;

placing the outer layer sheets on the first side of each foamed sponge layer sheet so that the foamed sponge layer sheet is substantially covered by the outer layer sheets;

placing the bladder on the second side of each foamed sponge layer sheet so that the foamed sponge layer sheets substantially cover the bladder to form a semi-finished ball carcass; and heat molding the semi-finished ball carcass to form an inflatable ball carcass having a sponge layer and a plurality of raised seams, the raised seams being formed from the outer layer sheets.

6. A method for forming an inflatable ball carcass having a sponge layer and a plurality of raised seams, the method comprising:

providing an inflatable bladder and a plurality of outer layer sheets;

providing two foamed sponge layer sheets, each foamed sponge layer sheet having a first side and a second side, and eight leaves extending from a center, the leaves shaped so that the foamed sponge layer sheet can be folded into substantially the shape of a hemisphere with substantially no gap remaining between each pair of adjacent leaves;

placing the outer layer sheets on the first side of each foamed sponge layer sheet so that the foamed sponge layer sheet is substantially covered by the outer layer sheets;

placing the bladder on the second side of each foamed sponge layer sheet so that the foamed sponge layer sheets substantially cover the bladder to form a semi-finished ball carcass; and heat molding the semi-finished ball carcass to form an inflatable ball carcass having a sponge layer and a plurality of raised seams, the raised seams being formed from the outer layer sheets.

7. A method for forming an inflatable ball carcass having a sponge layer, the method comprising:

providing an inflatable bladder and a plurality of outer layer sheets;

providing a plurality of foamed sponge layer sheets, the foamed sponge layer sheets having shapes such that they can be arranged into substantially the shape of a sphere with substantially no gap remaining between them;

arranging the outer layer sheets on the foamed sponge layer sheets so that a first side of the foamed sponge layer sheets is substantially covered by the outer layer sheets;

placing the bladder on a second side of the foamed sponge layer sheets so that the foamed sponge layer sheets substantially cover the bladder to form a semi-finished ball carcass; and heat molding the semi-finished ball carcass to form an inflatable ball carcass having a sponge layer.

8. The method of claim 7, wherein the inflatable ball carcass further comprises a plurality of raised seams which are formed from the outer layer sheets.

9. A method for forming an inflatable ball carcass having a sponge layer, the method comprising:

providing an inflatable bladder and a plurality of outer layer sheets;

providing a plurality of foamed sponge layer sheets, each sheet having a first side and a second side, and shaped so that the plurality of sheets can be folded into substantially the shape of a sphere with substantially no gap remaining between each pair of adjacent sheets;

placing the outer layer sheets on the first side of each foamed sponge layer sheet so that the sheets are substantially covered by the outer layer sheets;

placing the bladder on the second side of each foamed sponge layer sheet so that the plurality of sheets substantially cover the bladder to form a semi-finished ball carcass; and heat molding the semi-finished ball carcass to form an inflatable ball carcass having a sponge layer.

10. The method of claim 9, wherein the plurality of foamed sponge layer sheets is a total of two sheets.

11. The method of claim 9, wherein the plurality of foamed sponge layer sheets is a total of four sheets.

12. The method of claim 9, wherein the plurality of foamed sponge layer sheets is a total of eight sheets.

13. The method of claim 9, wherein the plurality of foamed sponge layer sheets is a total of sixteen sheets.

14. The method of claim 9, wherein all of the foamed sponge layer sheets have the same shape.

15. The method of claim 9, wherein the inflatable ball carcass further comprises a plurality of raised seams which are formed from the outer layer sheets.

* * * * *